US005372120A

United States Patent [19]

Swilik, Jr. et al.

[11] Patent Number: 5,372,120

[45] Date of Patent: Dec. 13, 1994

[54] SAFETY CIRCUIT FOR FURNACE

[76] Inventors: Robert C. Swilik, Jr., 7419 Bramblewood La., Indianapolis, Ind. 46254; Mark T. Whitaker, 126 Rose La., Greenwood, Ind. 46143

[21] Appl. No.: 97,281

[22] Filed: Jul. 23, 1993

[51] Int. Cl.[5] ..... F24H 3/00

[52] U.S. Cl. ..... 126/116 A; 431/78

[58] Field of Search ..... 126/116 A; 431/78

[56] References Cited

U.S. PATENT DOCUMENTS 3,254,871 6/1966 Limon .
4,296,727 10/1981 Bryan .
4,403,942 9/1983 Copenhaver .
4,410,132 10/1983 Levine .
4,411,385 10/1983 Lamkewitz .
4,575,333 3/1986 Bryant .
4,684,060 8/1987 Adams .
4,702,225 10/1987 Heffernan .
4,773,587 9/1988 Lipman .
4,777,929 10/1988 Welch .
4,789,330 12/1988 Ballard .
4,891,004 1/1990 Ballard .
4,982,721 1/1991 Lynch ..... 126/116 A
5,027,789 7/1991 Lynch ..... 126/116 A
5,135,162 8/1992 Holzer .
5,169,301 12/1992 Donnelly .
5,197,664 3/1993 Lynch ..... 126/116 A

*Primary Examiner*—Carroll B. Dority

[57] ABSTRACT

There is disclosed a modification in the control circuitry of a gas furnace having a primary or main limit whereby the primary circuit subsumes the functions of a the secondary or manual reset limit circuit. The control circuit incorporates a microprocessor capable of sensing conditions in the furnace, enabling and disabling the various furnace components. When an overtemperature condition is sensed the furnace is thereupon disabled by a process that executes in the microprocessor and comprises the repeated steps of: sensing if the limit switch is open; determining, in the event that the limit switch is open, whether the limit switch remains open for a period that exceeds a predetermined time interval; incrementing a cycle count in the event that the limit switch has remained open for the predetermined time period; waiting for the limit switch to reset in the event that the incremented cycle count does not exceed a predetermined value, and reinitiating the combustion cycle if the step of waiting was performed; and disabling the furnace in the event that the incremented cycle count exceeds the predetermined value.

10 Claims, 2 Drawing Sheets

SAFETY CIRCUIT FOR FURNACE

BACKGROUND OF THE INVENTION

1. Field of the Invention

This invention relates to a safety circuit in a forced air furnace. More particularly this invention relates to an improved apparatus for responding to a condition of an inoperative blower in a forced air furnace.

2. Description of the Prior Art

Conventional forced air furnaces such as gas-fired furnaces cycle on and off to maintain a desired temperature within a comfort space i.e., within a building interior.

A thermostat senses the temperature in the comfort zone relative to a predetermined set point temperature. When the temperature is below the set point, the thermostat closes to supply thermostat ac power to the furnace as a call for heat. This causes the furnace to come on, initiating an inducer motor to flow combustion air after which a gas valve is actuated to supply gas to the gas burners. An ignition device is also actuated to light the burners. A flame sensor then proves burner ignition and sends power to a blower delay timer. Then after a predetermined blower delay time, which varies with furnace design, the furnace blower is actuated. The blower moves circulating room air from a return air duct through the furnace heat exchanger to pick up heat from the heated combustion products (carbon dioxide and water vapor) from the gas burners. The heated circulate air then goes into a hot air plenum and is distributed through hot air ductwork back to the comfort space. When the comfort space air is warmed sufficient to reach the thermostat set point, the thermostat terminates the call for heat. When this happens the blower and burners go through a shut off sequence and the furnace awaits the next call for heat.

In the event the air flow is compromised due to duct restriction, obstruction or similar condition, a main limit circuit, incorporating an air temperature sensor, extinguishes the flame to prevent excessive furnace component temperatures and duct system temperatures. Upon reactivation of the main limit circuit, the unit initiates a new cycle and re-ignites the flame. On downflow or horizontal furnace applications where the filters are located above or parallel with the heat exchangers, a second switch is often incorporated to prevent the filter temperatures from rising excessively in the event the blower fails to operate. The second switch is often a manual reset type switch which prevents reactivation of the safety circuit until the switch is manually reset at which time the underlying fault is corrected.

While the second manual limit switch works well, it does involve additional hardware and associated wiring that adds to the expense of furnace construction and manufacturing.

SUMMARY OF THE INVENTION

It is therefore a primary object of the present invention to provide an improved safety circuit to protect a furnace in the event of an inoperable blower or an air flow impediment.

It is another object of the present invention to more economically provide a safety circuit in a furnace.

It is still another object of the present invention to eliminate expensive and unwieldy components in a limit circuit of a gas fired furnace.

These and other objects of the present invention are attained in a gas furnace by a modification in the control circuitry of the primary or main limit whereby the primary circuit subsumes the functions of the secondary or manual reset limit. In a gas furnace of the type which is responsive to a thermostat and has a circulating air blower, a gas valve for controlling gas supply to the furnace, an autoresettable limit switch sensitive to overtemperature, and a microprocessor responsive to the thermostat and the limit switch, the microprocessor controls the gas valve, and the circulating air blower. If an overtemperature condition is sensed, the furnace is disabled by a process initiated after initiation of a combustion cycle in the furnace. A program executes in the microprocessor and comprises the repeated steps of: sensing if the limit switch is open; determining, in the event that the limit switch is open, whether the limit switch remains open for a period that exceeds a predetermined time interval; incrementing a cycle count in the event that the limit switch has remained open for the predetermined time period; waiting for the limit switch to reset in the event that the incremented cycle count does not exceed a predetermined value, and reinitiating the combustion cycle if the step of waiting was performed; and disabling the furnace in the event that the incremented cycle count exceeds the predetermined value. The following steps disable the furnace and are conducted under microprocessor control: disabling the igniter; setting the gas valve to preclude gas from entering the furnace; disabling a response of the blower motor; determining if a flame is present in the furnace; and disabling the inducer motor in the event that a flame is not present in the furnace.

BRIEF DESCRIPTION OF THE DRAWING

For a better understanding of these and other objects of the present invention, reference is made to the detailed description of the invention which is to be read in conjunction with the following drawings, wherein.

DESCRIPTION OF THE PREFERRED EMBODIMENT

Figure 1:
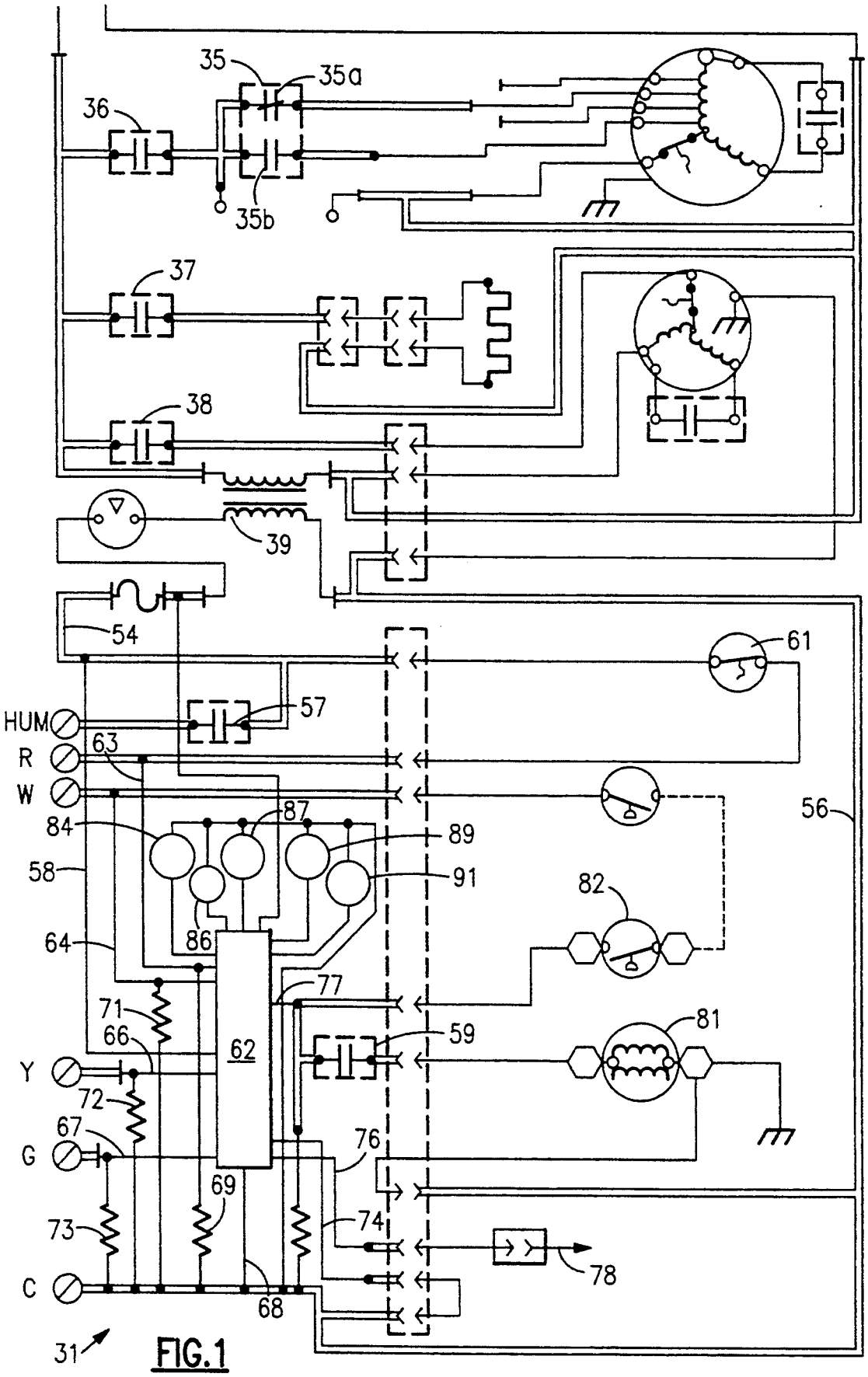
FIG. 1 is a schematic illustration of a furnace control system in accordance with the present invention.

Turning now to FIG. 1 of the Drawing, there is shown the controlling circuitry of an induced draft gas furnace adapted to operate in accordance with the present invention. The circuit, which is realized on a circuit board 31, is provided with line voltage through leads L1 and L2. Power is thereby provided to a circulating air blower motor, a hot surface igniter, and an inducer motor via relays 36, 37, and 38 respectively. Variable speed is selected via Hi/Lo relay 35. The control portion of the circuit is powered via low voltage stepdown transformer 39.

At the bottom portion of the circuit, the secondary coil of transformer 39 provides low voltage power to a common terminal C via conductor 56 and to a fused conductor 54 which is connected to a terminal HUM for auxiliary equipment, such as a humidifier, through normally open relay contacts 57. Conductor 54 also leads to a circuit containing an automatically resettable limit switch 61 which is sensitive to overtemperature, and then to the terminal R to supply power to the thermostat.

The R, W, Y, G, and C terminals of the circuit board 31 are connected in a conventional manner to a room thermostat (not shown), and also to a microprocessor 62, which can be a Microchip PIC16C57-RCI/P, by lines 63, 64, 66, 67, and 68 respectively. Load resistors 69, 71, 72, and 73 are provided between the common terminal C and the respective terminals R, W, Y, and G to increase current flow through their associated circuits to thereby prevent the occurrence of dry contacts.

Other inputs to the microprocessor 62 are provided via lines 74, 76, and 77. The line 76 is connected to a flame sensing electrode 78 to provide a signal to the microprocessor to indicate when a flame has been proven to exist. Line 77 provides an indication of the status of gas valve 81 and gas pressure switch 82. Line 74 provides an indication of the voltage on conductor 56. The controlling outputs 84, 86, 87, 89 and 91 of the microprocessor 62 operate relays 37, 38, 36, 35, and 57 respectively. Closure of relay contact 37 activates a hot surface igniter (not shown). When relays 37 and 38 close, the inducer motor (not shown) and blower motor (not shown) are respectively activated. The output 89 causes one of contacts 35*a* and 35*b* of relay 35 to close and the other contact to open, thereby selecting a high or low speed operation. Lastly, the output 91 activates relay 57 to operate the auxiliary equipment (not shown) and also relay 59, which enables gas flow via valve 81.

Input line 58 provides an indication of the status of limit switch 61.

Figure 2:
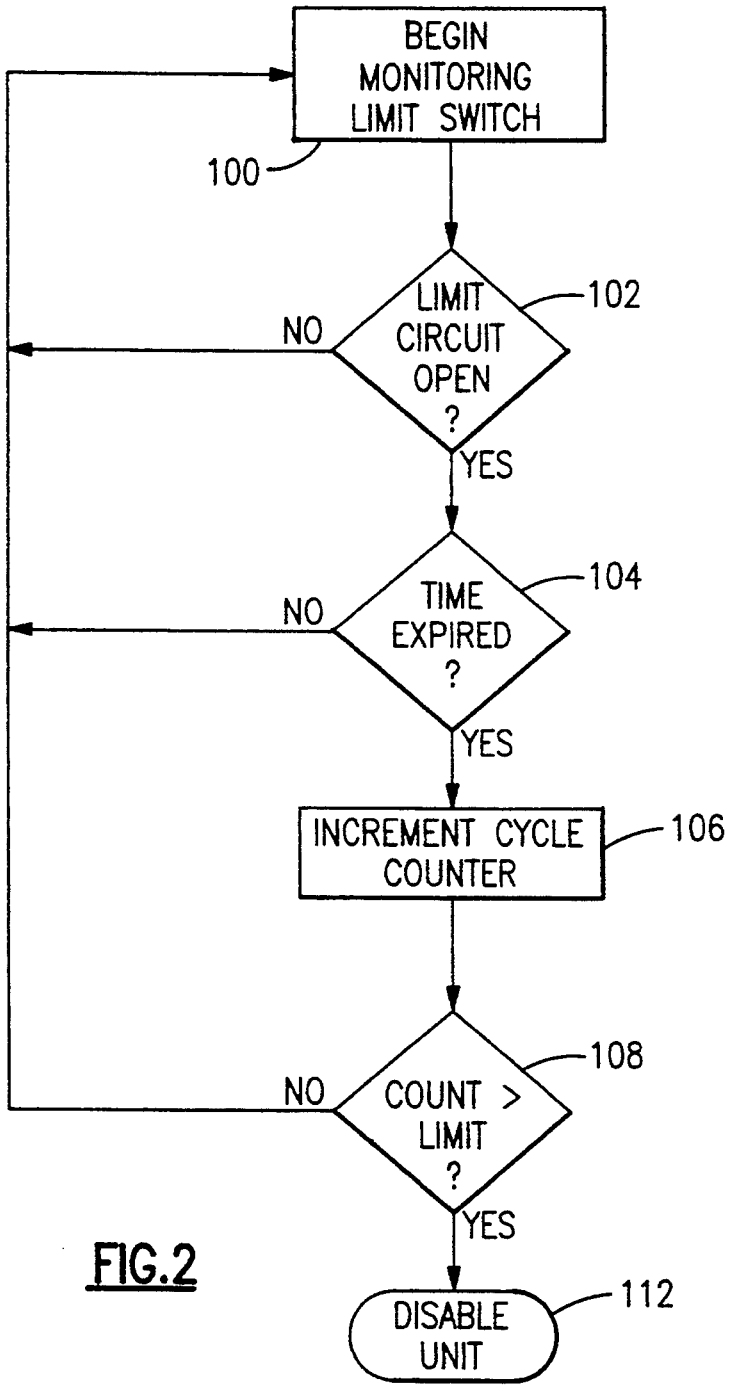
FIG. 2 is a flow chart of the operation of the control system in the furnace shown in FIG. 1.

The operation of the microprocessor 62 is explained with reference to FIG. 2. At step 100 a call for heat is recognized by microprocessor 62 and a combustion cycle initiated in a conventional manner. At step 102 the voltage on conductor 54 is sensed by the microprocessor 62 via line 58. If limit switch 61 is closed, line 52 will be high, indicating a normal condition, and the program loops back to repeat checking the limit switch. On the other hand, if an overtemperature condition exits, limit switch 61 will be open, which will be reflected as a low voltage on line 58. A timer is then initiated at step 106. The timer is preferably implemented in software, but it can be any conventional hardware device suitably connected to the microprocessor 62, or could be integrated in the microprocessor itself. Eventually one of two events will occur. The limit switch may close, indicating that the overtemperature is no longer present. If this occurs, the program loops back to its starting point at step 100, indicating a state of normal operation. On the other hand the limit switch may not close, and a preset time interval, preferably in the range of 1–4 minutes, will expire. In the latter event, a counter is incremented at step 106. At step 108 the counter is evaluated. If a predetermined value, preferably 1, is not exceeded, then the program awaits the automatic closure of the reset switch 61 at step 110, and returns to step 100 to again monitor the limit switch. However if a predetermined number of cycles have occurred and normal operation still has not been established, then it is presumed that an unsafe condition exists, and the furnace is locked out or disabled at step 112.

To disable the furnace, the microprocessor appropriately changes the state of its various outputs. Output 84 is asserted in order to open the contacts of relay 37, thereby disabling the igniter. Output 87 causes the contacts of relay 36 to open, disabling the blower motor. Output 91 is asserted to open relays 57 and 59 in order to cut off gas flow via valve 81, and to disable any auxiliary equipment. In the event that a flame is present, as sensed via line 76, the inducer motor continues to run; otherwise output 86 opens relay 38 to disable the inducer motor. The furnace is thereupon locked out pending correction of the fault by an operator or a serviceman.

I thus provide an improved method of safely detecting overtemperature in a gas furnace and reacting appropriately to a fault condition without resorting to the manual reset switch that characterizes the prior art methods.

While this invention has been explained with reference to the structure disclosed herein, it is not confined to the details set forth and this application is intended to cover any modifications and changes as may come within the scope of the following claims:

What is claimed is:

1. In a gas furnace of the type which is responsive to a thermostat and has a circulating air blower, a gas valve for controlling gas supply to the furnace, an autoresettable limit switch sensitive to overtemperature, and a microprocessor responsive to the thermostat and the limit switch, the microprocessor controlling the gas valve, and the circulating air blower, a process for sensing an unsafe temperature condition and thereupon disabling the furnace, the process comprising the step of, upon initiation of a combustion cycle in the furnace, executing a program in the microprocessor, the program comprising the steps of:

sensing if the limit switch is open; determining, in the event that the limit switch is open, whether the limit switch remains open for a period that exceeds a predetermined time period;

disabling the furnace in the event that the limit switch has remained open for said predetermined time period; and reinitiating the combustion cycle if said limit switch has not remained open for said predetermined time period.

2. The process according to claim 1, wherein said predetermined time period is 3 minutes.

3. The process according to claim 1, wherein said step of reinitiating the combustion cycle further comprises the step of waiting for the limit switch to reset.

4. The process according to claim 1, wherein said step of disabling the furnace comprises the steps of disabling the igniter;

setting the gas valve to preclude gas from entering the furnace; and disabling a response of said blower motor.

5. The process according to claim 4, wherein said step of disabling the furnace further comprises the steps of:

determining if a flame is present in the furnace; and disabling the inducer motor in the event that a flame is not present in the furnace.

6. In an induced draft gas furnace of the type which is responsive to a thermostat and has an igniter, an inducer motor, a circulating air blower, a gas valve for controlling gas supply to the furnace, an autoresettable limit switch sensitive to overtemperature, and a microprocessor responsive to the thermostat and the limit switch, the microprocessor controlling the igniter, inducer motor, gas valve, and the circulating air blower, a process for sensing an overtemperature condition and thereupon disabling the furnace, initiated after initiation of a combustion cycle in the furnace, executing a program in the microprocessor, the program comprising the repeated steps of:

sensing if the limit switch is open;

determining, in the event that the limit switch is open, whether the limit switch remains open for a period that exceeds a predetermined time interval;

incrementing a cycle count in the event that the limit switch has remained open for said predetermined time period;

waiting for the limit switch to reset in the event that the incremented cycle count does not exceed a predetermined value, and reinitiating the combustion cycle if said step of waiting was performed; and disabling the furnace in the event that the incremented cycle count exceeds said predetermined value by the steps of:

disabling the igniter;

setting the gas valve to preclude gas from entering the furnace;

disabling a response of said blower motor;

determining if a flame is present in the furnace; and disabling the inducer motor in the event that a flame is not present in the furnace.

7. The process according to claim 6, wherein said predetermined time interval is 3 minutes.

8. The process according to claim 6, wherein said predetermined value of said cycle count is 1.

9. The process according to claim 1 and including the steps of incrementing a cycle count in the event that the limit switch has remained open for said predetermined time period;

disabling the furnace in the event the incremented cycle count exceeds a predetermined number; and reinitiating the combustion cycle if said incremented cycle count does not exceed said predetermined number.

10. The process according to claim 9, wherein said predetermined number of said cycle count is 0.

* * * * *